United States Patent [19]

Chen et al.

[11] Patent Number: 4,864,319

[45] Date of Patent: Sep. 5, 1989

[54] RADIO FREQUENCY ANTENNA WITH SMALL CROSS-SECTION

[75] Inventors: Sinclair N. C. Chen; Donald H. Archer, both of Santa Barbara, Calif.

[73] Assignee: Raytheon Company, Lexington, Mass.

[21] Appl. No.: 142,197

[22] Filed: May 11, 1971

[51] Int. Cl.[4] ..... H01Q 13/00

[52] U.S. Cl. ..... 343/786; 343/780; 343/835

[58] Field of Search ..... 343/912, 835, 780, 18 E, 343/786

[56] References Cited

U.S. PATENT DOCUMENTS

| | | | |
|---|---|---|---|
| 2,446,024 | 7/1948 | Porter et al. | 343/7.4 |
| 2,522,562 | 9/1950 | Blitz | 343/912 X |
| 3,307,188 | 2/1967 | Marchetti et al. | 343/100 SA |

*Primary Examiner*—Thomas H. Tarcza
*Assistant Examiner*—Linda J. Wallace
*Attorney, Agent, or Firm*—Philip J. McFarland; Richard M. Sharkansky

[57] ABSTRACT

An array antenna is shown, the disclosed antenna having an effective cross-sectional area which is lower than its physical cross-sectional area. The reduction in effective cross-sectional area is effected by: (a) fabricating the reflector for the array antenna from spaced wires; and, (b) curving the entire array and its reflector.

3 Claims, 1 Drawing Sheet

RADIO FREQUENCY ANTENNA WITH SMALL CROSS-SECTION

BACKGROUND OF THE INVENTION

This invention pertains generally to antennas for radio frequency energy and particularly to array antennas for such energy.

Extensive work has been carried on for many years in attempts to enhance or reduce the radar cross-section (hereinafter sometimes referred to as "RCS") of different objects. In the course of such work it has been found that the monostatic and bistatic RCS of simple geometric shapes, as planar or spherical surfaces can be quantitatively evaluated to a great degree of accuracy. When the motion of the simple objects, with the exception of sphere, varies in a random and unpredictable manner, it has been customary for many system analysis purposes to considre the average RCS of such objects as the criterion for their RCS. When relatively complex objects, such as aircraft, are considered, the average RCS may not serve as an effective criterion because of the unpredictable variations in RCS as a function of variations of such object's aspect angle. When complex objects are considered, it is sometimes more convenient to use the peak, meaning the greatest, RCS as the criterion.

Whether one considers a complex object such as an aircraft in terms of its average or its peak RCS, it is evident that, if it is desired to reduce the probability of its detection by an interrogating radar, both the average and peak RCS of the aircraft and any equipment carried thereon which contributes to the RCS need be reduced. In the particular case in which a radar incorporating a phased array antenna is carried by an aircraft, an array may, at certain aspect angles, contribute significantly to the RCS.

Known ways of reducing RCS, as the employment of radio frequency absorbing materials or quarter-wave traps, cannot be used to any advantage with phased array antennas. The primary reason for the limited utility of such approaches is that known techniques may not be applied to phase array antennas without destroying their effectiveness. Further, any technique based on creating destructive interference is inherently effective only against interrogating signals within a narrow band.

Therefore, it is a primary object of this invention to provide an improved phased array antenna with a reduced peak and average RCS as compared to known phased array antennas.

Another object of this invention is to provide an improved phased array antenna as just mentioned, such antenna further maintaining its lower RCS over a broad band of frequencies.

These and other objects of this invention are attained generally by providing a phased array antenna in which: (a) the radiation elements and other beam forming elements of such array are disposed on a curved suface, thereby to impress a tapered phase distribution on energy reflected from such radiating and beam forming elements; and, (b) a wire mesh is used to shape the beam of the phased array antenna in the plane orthogonal to the plane of the array's radiation elements, the spacing of the wires making up such grid being as wide as possible and yet to close enough to retain the desired performance of the antenna.

For a more complete understanding of this invention, reference is now made to the following description of a preferred embodiment as illustrated in the accompanying drawing, in which:

FIG. 1 is a perspective view, partially cut away to better show pertinent details of the array antenna according to our invention, such antenna being shown in relation to other main elements of a typical airborne system; and, FIG. 2 is a graph showing in particular the effective decrease in reflected energy of an array antenna of the type shown in FIG. 1.

DESCRIPTION OF THE PREFERRED EMBODIMENT

Figure 1:
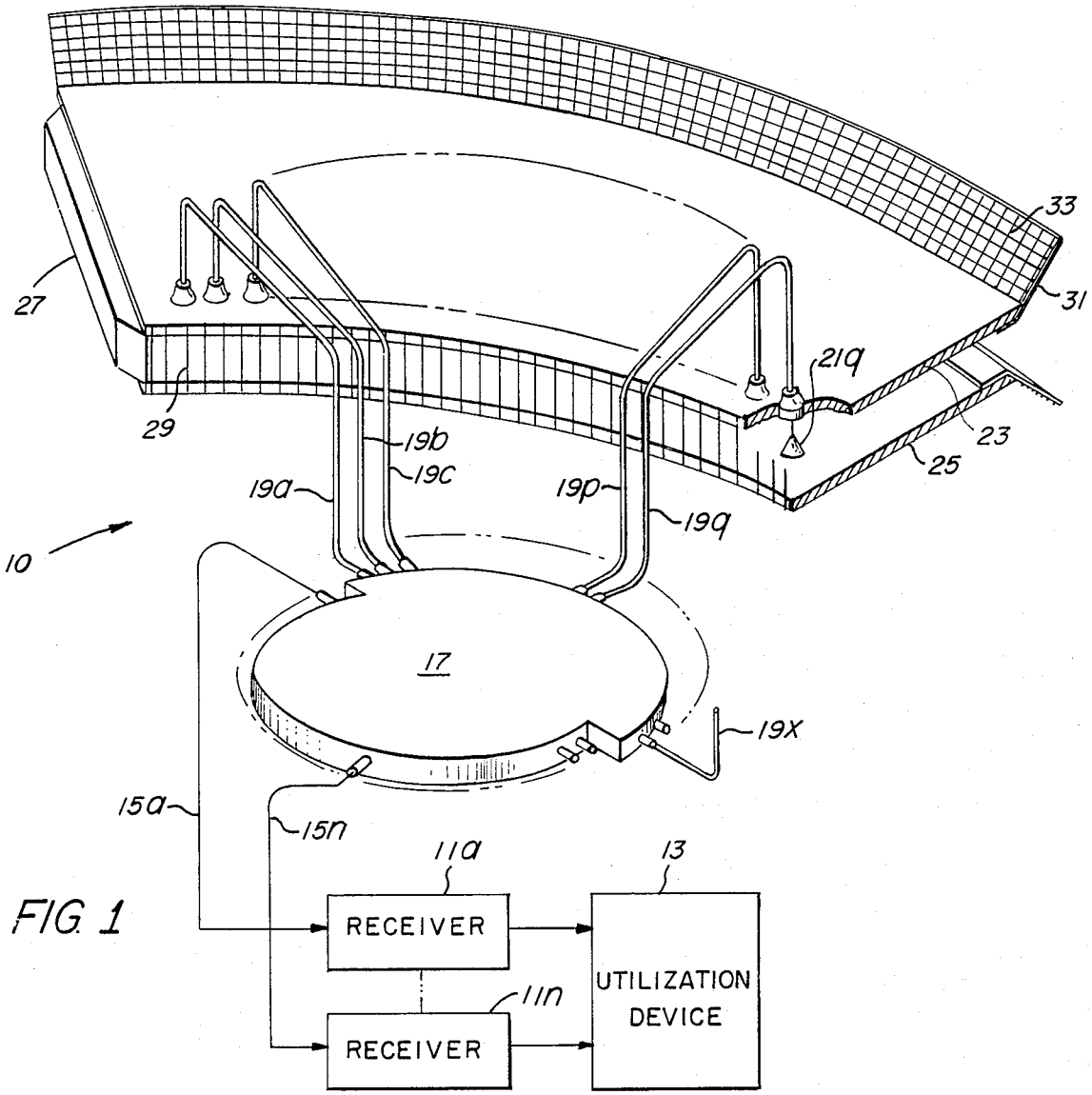

Referring now to FIG. 1, it may be seen that a direction finder according to this invention comprises a multi-beam array antenna 10, to be described hereinafter, a plurality of receivers 11*a* through 11*n*, and a utilization device 13. Except for the multi-beam array antenna 10, the just-mentioned elements preferably are conventional. Thus, the receivers 11*a* through 11*n* may be any well-known heterodyne receiver adapted to respond to radio frequency signals within a desired band to produce an appropriate amplified signal for the utilization device 13. The latter, in its simplest form, may be an arrangement of indicator lamps disposed so that each separate one is responsive to an output signal from a different one of the receivers 11*a* through 11*n*.

The multi-beam array antenna 10 here illustrated is a linear array of the type described by Rotman "Multiple Beam Radar Antenna System," U.S. Pat. No. 3,170,158 issued Feb. 16, 1965. Thus, each one of the receivers 11*a* through 11*n* is connected through a corresponding one of a similar number of transmission lines 15*a* through 15*n* and probes (not shown) to a point (not numbered) along the focal arc of a parallel-plate lens 17. A plurality of coaxial lines 19*a* through 19*x* (which plurality need not be, and ordinarily is not, the same as the plurality of transmission lines 15*a* through 15*n*) is connected as shown, between the parallel-plate lens 17 and a linear array of antenna elements, as antenna element 21*q* mounted within a horn (not numbered). The upper and lower walls of the horn are, respectively, a curved upper plate 23 and a curved lower plate 25 which are disposed in a substantially parallel relationship to each other in any convenient manner, as by spacer 27. The back wall of the horn is formed by attaching, in any convenient manner, a plurality of conducting wires, as wire 29, to the curved upper plate 23 and the curved lower plate 25. Such wires are disposed substantially parallel to each other and to the E-field within the horn. The spacing between adjacent ones of such wires is dependent upon the wavelength of the highest frquency to which the antenna elements, as antenna element 21*q*, are intended to be responsive. The front end of the horn is made up of an upper flare portion and a lower flare portion, each such portion including an arcuate nonconducting support member 31 supporting a conducting wire grid 33. Each such support member and grid is affixed to the corresponding curved upper and lower plates 23, 25. The spacing of each individual grid of the conducting wire grid is depending upon the wavelength of the highest frequency to which the antenna elements, as antenna element 21*q*, are intended to be responsive. It is evident, therefore, that the back wall of the horn and the front end thereof may be so constructed as to appear to be solid conductive members to radio frequency energy having a frequency below a predetermined frequency and to appear to be substantially transparent to radio frequency energy having a higher frequency.

Figure 2:
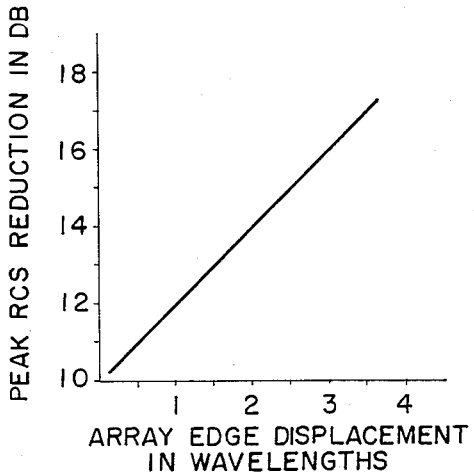

The curvature of the curved upper plate 23 and the curved lower plate 25 (which curvature controls the curvature of the back wall and the front end of the horn) is important even though it may be varied within rather wide limits as shown in FIG. 2. In that figure the abscissa "Array Edge Displacement In Wavelengths", means the distance, in terms of the wavelength of radio frequency energy of any selected frequency, from the tangent to the midpoint of the horn to the tangent to the horn at the outmost antenna element on either side. Obviously, if frequency of the radio frequency energy is assumed and the spacing between successive antenna elements is known, then the radius of curvature to attain a desired reduction in the peak RCS may be calculated.

The effectiveness with which an array antenna according to our invention is reducing RCS may best be appreciated by comparing the peak and average values of backscattered radio frequency energy from an array antenna according to our invention with the peak and the average value of the backscattered energy from a conventional, i.e. a linear array antenna having a horn made of solid conducting material, array antenna of similar size. Thus, upon illuminating a conventional array antenna having a design frequency of 4 GHz as its center frequency and a comparable array antenna having an array edge displacement of 1.5 wavelengths at 4 GHz, it will be found that the peak value of the backscattered energy is markedly less for the latter. For example, if the illuminating energy is at 4 GHz, the peak value of the backscattered energy from an array antenna of our design is approximately 13 db down from the peak value from a conventional array antenna. If the frequency of the illuminating energy is 10 GHz, the difference between the peak backscattered energy from the two is about 27 db. With respect to the average backscattered energy, an array antenna according to our invention yields a 3 dB reduction in RCS when the frequency of the illuminating energy is 4 GHz. When such frequency is 10 GHz, our invention yields a 5 dB reduction in RCS.

It will be evident to one of skill in the art that the particular shape of the horn we contemplate may be changed without departing from our inventive concepts. Thus, it is obvious that, so long as the array antenna is not linear, any shape within a large class of shapes may be used. Further, it is evident that a planar array may incorporate our concepts for reducing RCS. It is felt, therefore, that this invention should not be restricted to its disclosed embodiment, but rather should be limited only by the spirit and scope of the appended claims.

What is claimed is:

1. In an array antenna assembly for radio frequency energy, such assembly including an array of antenna elements, the improvement comprising:

(a) a pair of opposing arcuate plates substantially parallel to one another, the array of antenna elements being disposed along an arcuate path between such plates;

(b) a first electrically conductive mesh disposed to cover the space defined by the shorter arcs formed by the pair of opposing arcuate plates, the openings in such mesh being less than one-eighth the wavelength of a predetermined frequency; and (c) a second and a third electrically conductive mesh disposed, respectively, along the longer arc formed by the pair of opposing arcuate plates, each one of the second and third such mesh being flared outwardly from the pair of opposing arcuate plates, the openings in each one of the second and the third mesh being less than one-eighth the wavelength of the predetermined frequency.

2. The improvement as in claim 1 wherein each one of the pair of opposing arcuate plates is convex in the direction of the at least one beam of radio frequency energy.

3. The improvement as in claim 1 wherein the convexity of each one of the pair of opposing arcuate plates, measured from a line tangent to the center of the array of antenna elements to the outside edge of such array, exceeds one-half wavelength of radio frequency energy at the predetermined frequency.

* * * * *